United States Patent [19]

Mazer et al.

[11] 4,256,468

[45] Mar. 17, 1981

[54] METHOD FOR CLEANING SINTER PLANT GAS EMISSIONS

[75] Inventors: Marshall R. Mazer, Allentown; Steven A. Jassund, Quakertown; Stewart T. Herman, Hellertown, all of Pa.

[73] Assignee: Bethlehem Steel Corporation, Bethlehem, Pa.

[21] Appl. No.: 57,230

[22] Filed: Jul. 13, 1979

Related U.S. Application Data

[63] Continuation of Ser. No. 865,359, Dec. 28, 1977, abandoned.

[51] Int. Cl.[3] ..... B03C 3/01; B03C 3/16; B03C 3/53

[52] U.S. Cl. ..... 55/8; 55/13; 55/85; 55/89; 55/118; 55/120; 55/122; 55/150; 55/154; 55/228; 55/435; 55/127

[58] Field of Search ..... 55/7, 8, 10, 13, 85, 55/89, 94, 118–120, 122, 126, 150, 154, 228, 435, 127; 23/252 A; 423/242 A

[56] References Cited

U.S. PATENT DOCUMENTS

| | | | |
|---|---|---|---|
| 1,905,993 | 4/1933 | Buff | 55/118 |
| 2,800,192 | 7/1957 | Roberts | 55/7 |
| 3,033,918 | 5/1962 | Wiemer | 174/139 |
| 3,248,857 | 5/1966 | Weindel et al. | 55/118 |
| 3,395,193 | 7/1968 | Bruce et al. | 55/119 |
| 3,726,062 | 4/1973 | Hungate et al. | 55/94 |
| 3,773,966 | 11/1973 | Ebert et al. | 55/120 |
| 3,785,119 | 1/1974 | McIlvaine | 55/7 |
| 3,794,714 | 2/1974 | Atsukawa et al. | 423/242 A |
| 3,816,077 | 6/1974 | Fuller et al. | 23/252 A |
| 3,818,682 | 6/1974 | Farrow et al. | 55/106 |
| 3,874,858 | 4/1975 | Klugman et al. | 55/118 |
| 3,944,401 | 3/1976 | Dörr et al. | 55/94 |
| 3,958,961 | 5/1976 | Bakke | 55/118 |
| 4,049,399 | 9/1977 | Teller | 55/94 |

FOREIGN PATENT DOCUMENTS

| | | | |
|---|---|---|---|
| 2148902 | 5/1972 | Fed. Rep. of Germany | 55/10 |
| 2500888 | 7/1976 | Fed. Rep. of Germany | 55/154 |
| 1431903 | 4/1976 | United Kingdom | 23/252 A |
| 1436826 | 5/1976 | United Kingdom | 55/154 |
| 1485259 | 9/1977 | United Kingdom | 55/8 |

OTHER PUBLICATIONS

Fluid-Ionic Systems, "Hydro-Precipitrol," Attachment 7, HP1, 1/5/76.

Fluid-Ionic Systems, "Hydro-Precipitrol," Wetted Wall Electrostatic Precipitator, 9/1977.

Hydro-Precipitrol, Pollution Engineering, Aug. 1976, p. 55, Press Release, 3/31/1976.

M. Mazer et al., Adaptation of Wet Electrostatic Precipitators for Control of Sinter Plant Windbox Emissions, Presented Jun. 20–24, 1977 at Air Pollution Control Association, Toronto, Canada, pp. 1–16.

*Primary Examiner*—David L. Lacey

*Attorney, Agent, or Firm*—Joseph J. O'Keefe; Charles A. Wilkinson; Michael Leach

[57] ABSTRACT

A method for cleaning sinter plant gas emissions using a wet electrostatic precipitator system having separate recirculating wash liquor loops for the high voltage precipitator section and the pre-scrubber section. The system is operated with acidic washing liquor to avoid scaling and deposition of solids within the system.

10 Claims, 4 Drawing Figures

METHOD FOR CLEANING SINTER PLANT GAS EMISSIONS

This is a continuation of application Ser. No. 865,359, filed Dec. 28, 1977, now abandoned.

FIELD OF INVENTION

This invention relates to gas cleaning and more particularly to gas cleaning by the removal of particulate and condensable matter in a wet electrostatic precipitator.

PRIOR ART BACKGROUND

Sintering plants produce valuable feedstocks for blast furnaces from fluxes, ore fines and various ferrous waste materials such as blast furnace flue dust and oily mill scale. The gases emanating from the sintering plant windboxes contain entrained particulate matter, soluble solids, the acid gases $SO_2$ and $CO_2$ and condensable hydrocarbons. Sinter plant windbox emissions have proven difficult to clean economically, particularly in the face of the escalating cost of energy.

Mechanical gas cleaners were initially used for removing particulates from sinter windbox emissions. Subsequently, mechanical gas cleaners were generally replaced with dry electrostatic precipitators. Because of the failure to remove condensable matter which escaped as fume from dry electrostatic precipitators, wet collection devices were then developed. Wet venturi scrubbers are efficient gas cleaners, but they operate with a high consumption of energy. Accordingly, attention has focused on wet electrostatic precipitators (WESP) for they can adequately clean the sinter windbox gas streams at a low level of energy consumption. Several commercially available WESP systems, as an added feature, incorporate a pre-scrubber spraying section ahead of the high voltage electrostatic precipitator section.

However, several problems have prevented the successful utilization of WESP systems for sinter plant emissions control. Firstly, when a WESP system is operated with once-through wash water, the enormous quantity of contaminated water for disposal (blowdown) has a total dissolved solids content that may be in excess of that permitted by wastewater regulations even though the concentration of dissolved solids in the water is low. Also, this huge volume of spent wash water would either overtax the capacity of present water treatment plants or require construction of very large treatment plants. Secondly, while recycling of the WESP system water will allow a minimum discharge and water treatment, recirculation creates an acidic, corrosive environment (for example, pH3; 500 ppm chloride ion concentration) within the apparatus that is unacceptable to continuous trouble-free operation.

In order to minimize corrosion of wet gas cleaning apparatus due to the acid nature of the recycled system water it has been customary to neutralize the recirculating water with caustic soda or the like. Since calcium and magnesium, which are present in the sinter strand mix, are being removed from the windbox gas stream by the WESP system and are accumulating in the recirculating water, neutralization of the recirculating water with caustic to avoid an acidic liquor results in the deposition of calcium and magnesium carbonates within the apparatus. To maintain the discharge water at pH 7, the water entering the WESP must be at least pH 10.

The combination of the accumulating calcium concentration and this neutral to slightly basic environment dictates that the solubility of calcium carbonate is eventually surpassed and undesirable scale deposits will form.

Additionally, recirculation of the water means recirculating the particulate matter extracted from the gas stream with the inevitable clogging and plugging of the water sprays or water distributors that provide the collecting electrodes of the WESP with a cascading flow of washing water. This problem is particularly pronounced in WESP systems having low pressure water distributors.

Accordingly, there is a need for the capability to treat sinter plant windbox gases so as to meet stringent air and water pollution codes while minimizing the expenditure of energy.

In addition, there is a need for a WESP system for sinter plant emissions that can minimize the discharge of wastewaters from the WESP by recirculating acidic washing water.

There is a further need for a WESP system that recirculates the water without obstructing or stopping the water sprays or distributors with particulate matter extracted from the treated gases.

SUMMARY OF THE INVENTION

The difficulties previously associated with removing solid particles and condensable matter from gas streams also containing acidic gases and soluble solids, such as sinter plant gases, can be solved in accordance with the present invention. The dirty gases, from the sinter plant as an example, are cleaned with a wet electrostatic precipitator system that has a pre-scrubber section preceding a high-voltage precipitator section and is operated in an acidic mode to minimize scaling by deposition of calcium and magnesium carbonates. "Operating in an acidic mode" means the washing water or liquor for the pre-scrubber section and the collector electrodes in the high voltage section has a pH value below 7.

Previously, the aqueous washing liquor that drained from the collector electrodes in the high voltage section was subsequently sprayed into the pre-scrubber section to saturate and cool the incoming gas. The spent washing liquor was either discarded or neutralized and recycled to the high voltage section. The present invention separates the recirculated aqueous washing liquor into two recirculating liquor loops. The collected pre-scrubber water is recycled to the sprayers in the pre-scrubber section and in the high voltage section the wash water from the collector electrodes is recycled to the liquor dispensing means for coating the collector electrodes with a film of washing water.

By having two different recirculating water paths the pre-scrubber extracts coarse particulates and soluble matter and absorbs the acidic gases $CO_2$ and $SO_2$ from the sintering plant gases. Thus the very difficult to clean, downstream high voltage section possesses an environment that is less hostile and is more conductive to trouble-free operation. The gas stream which leaves the pre-scrubber contains less soluble and corrosive matter than that which enters the pre-scrubber. Thus the propensity to cause scaling or corrosion within the intricate electrostatic precipitator section is reduced. The water containing the coarse particulates and dissolved matter is only recirculated within the pre-scrubber section. Since the pre-scrubber water is not recycled to the high voltage section, the sprays or holes in the liquor distributing means for the collector electrode cannot be plugged by any coarse particulates journeying into the high voltage water recycle. Furthermore, the condensable gaseous matter, such as hydrocarbons, forms droplets when the gas stream is humidified and cooled in the pre-scrubber and may be removed there, or as it passes through the high voltage section.

Because the pre-scrubber water is recirculated one would readily expect the accumulating dissolved matter to present a potential for scaling and deposition of solids. By operating in the acid mode carbonates do not scale out and calcium sulfate does not precipitate because the $SO_2$ which is absorbed into the water as sulfite is not oxidized to sulfate. It exists as the much more soluble calcium hydrogen sulfite.

DETAILED DESCRIPTION OF THE INVENTION

The present invention solves the problem of effectively and economically reducing to within regulatory environmental limits the levels of particulate and condensable hydrocarbon emissions from sinter plants. A low energy consuming wet electrostatic precipitator is operated so that the high-voltage precipitator section and the pre-scrubber section have separate recirculating wash liquor paths which recycle an acidic aqueous liquor.

Figure 1A:
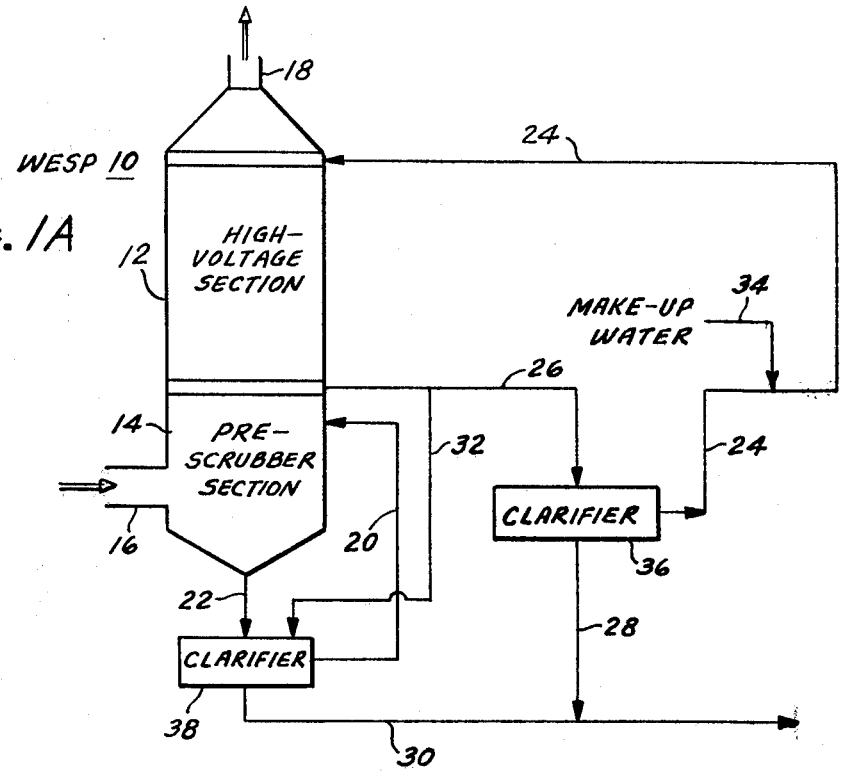
FIG. 1A is a preferred embodiment of the gas cleaning system depicted in FIG. 1.
Figure 1:
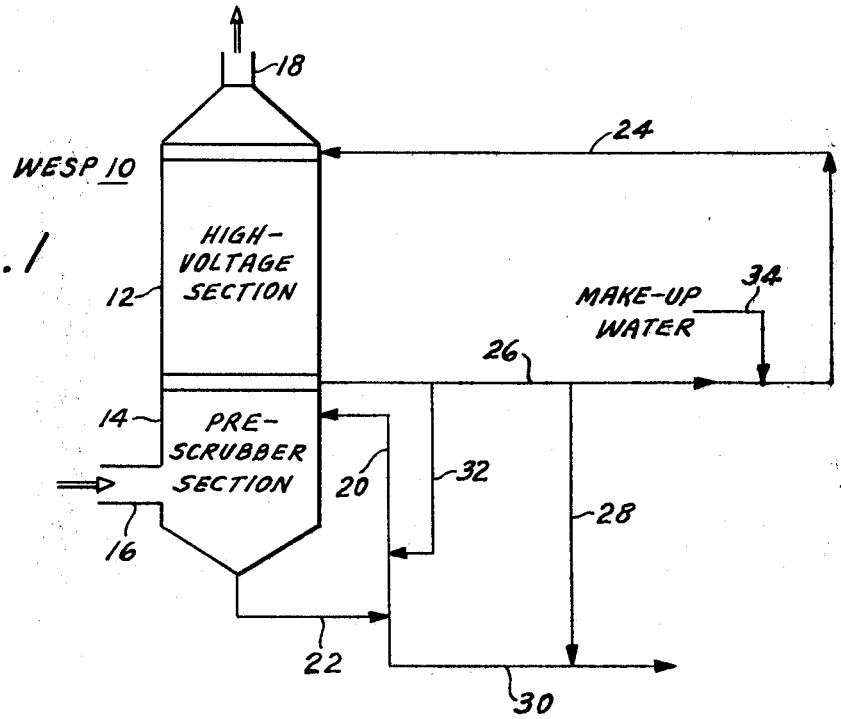
FIG. 1 is a schematic diagram of a wet electrostatic precipitator system for gas cleaning embodying the invention.

FIG. 1 depicts the invention in its basic embodiment. The wet electrostatic precipitator 10 used in this invention comprises a high voltage section 12 and a pre-scrubber section 14. The gas stream, laden with particulates, acidic gases and consensable matter, enters the pre-scrubber 14 via gas inlet 16 where it is sprayed with wash water which humidifies and cools the gas stream, as well as removes coarse particles, causing condensables to form droplets most of which are flushed from the gas stream. At this point also $SO_2$ and $CO_2$ are absorbed. The gas stream proceeds into the high voltage section 12 where a discharge electrode imparts a charge to any remaining condensed droplets and any fine particulates whereby they migrate to a grounded wet collector electrode and are removed from the gas stream. As a result clean gas is exhausted to the atmosphere through outlet 18.

The wash water for the sprays in pre-scrubber section 14 is supplied by line 20. After contacting the incoming sinter plant gases, the sprayed wash water is collected in the bottom of the pre-scrubber section and exits via line 22 to be recycled into line 20. The wash water attains an acidic pH due to the absorption of $SO_2$ and $CO_2$ which form sulfurous acid and carbonic acid respectively upon reaction with the water. Operation in this acidic mode is essential for cleaning sinter plant emissions according to this invention. A pH range of about 2 to about 6.5 is preferred and a range of about 2.5 to about 5 more preferred. It is possible to maintain a most preferred pH range of 3–4 solely by the absorption of the acidic gases. Where the dirty gas stream is such that absorption of acidic gases is not sufficient to maintain an acidic pH, acid can be added from an external source. If the water becomes too acid for some reason, base can be added to raise the pH to at least 2.

In addition, the pre-scrubber water attains corrosive properties by extracting almost all of the chloride from the gases as well as extracting calcium and magnesium. In the acidic environment calcium and magnesium carbonates do not deposit and the sulfite ($SO_3^{-2}$) which is formed by reaction of water and $SO_2$ exists as the much more soluble calcium hydrogen sulfite rather than oxidizing to sulfate ($SO_4^{-2}$) as in a neutral to basic solution and forming the insoluble calcium sulfate.

In the high voltage section the water that cascades down the surface of the collector electrode to wash off captured particulates is supplied to the liquor distributors or sprayers depending on the apparatus used by line 24. The wash water draining from the collector electrode is accumulated and leaves the high voltage section in line 26 to be recycled into line 24. As in the pre-scrubber the recirculating water in the high voltage attains a low pH because a small amount of unabsorbed acidic gases which pass through the pre-scrubber absorbs here and any acidic water droplets in the form of a mist from the prescrubber is removed here. Again, a pH range from about 2 to about 6.5 is preferred and from about 2.5 to 5 more preferred. A pH range from 3 to 4 is most desirable. The accumulation of those dissolved solids which tend to form adherent deposits is minimal for virtually complete removal of these constituents occurs in the pre-scrubber. Therefore, deposition and scaling problems are minimized.

Since the water in both sections recirculates, the concentration of dissolved material and the extracted particulates gradually increases. A bleed-off line is suggested to avoid problems associated with this build-up of material. It is preferred that a portion of each recirculating washing solution be bled off as shown by line 28 from the high voltage recycle loop merging with bleed-off line 30 from the pre-scrubber recycle loop for discharge. As an alternative to line 28, it is preferably to have a bleed-off line 32 from the high voltage recycle loop connect with the pre-scrubber loop because the high voltage wash water contains only a small amount of dissolved solids, fine particulates and condensed hydrocarbons and is relatively clean in comparison to the pre-scrubber liquor. With wash water being removed from the high voltage loop into the pre-scrubber loop and then bled from the latter recycle loop, an equivalent amount of make up water is continually added via line 34 into the high voltage recycle loop.

FIG. 1A shows the WESP recirculating system of FIG. 1 in a preferred embodiment. In the FIGURES similar structures are given the same numerical identification. Clarifier 36 is interposed in the high voltage recycle loop to allow the suspended solids in the recirculating liquor to settle out and be removed as a slurry via line 28. Clarified liquor leaves the clarifier in line 24 and with make up water that is subsequently introduced by line 34 returns to the collector electrode. Clarifier 38 positioned in the pre-scrubber recycle loop helps remove from the wash liquor the large amount of particulate matter flushed out of the gas stream so that a clarified liquor is recirculated to the sprays. Clarifier 38 is fed liquors containing suspended solids by the drainage from the pre-scrubber bottom through line 22 and bleed off line 32 from the high voltage loop.

Under normal conditions the condensed hydrocarbons adhere to the particulates washed from the gas stream as suspended solids that can be removed in the clarifiers. When the dirty gas stream contains such a large amount of condensable hydrocarbons that a layer of these condensed hydrocarbons appears on the surface of the clarified liquor, the clarifiers should be equipped with skimmers to remove this material in order to prevent clogging of the WESP apparatus.

Figure 2:
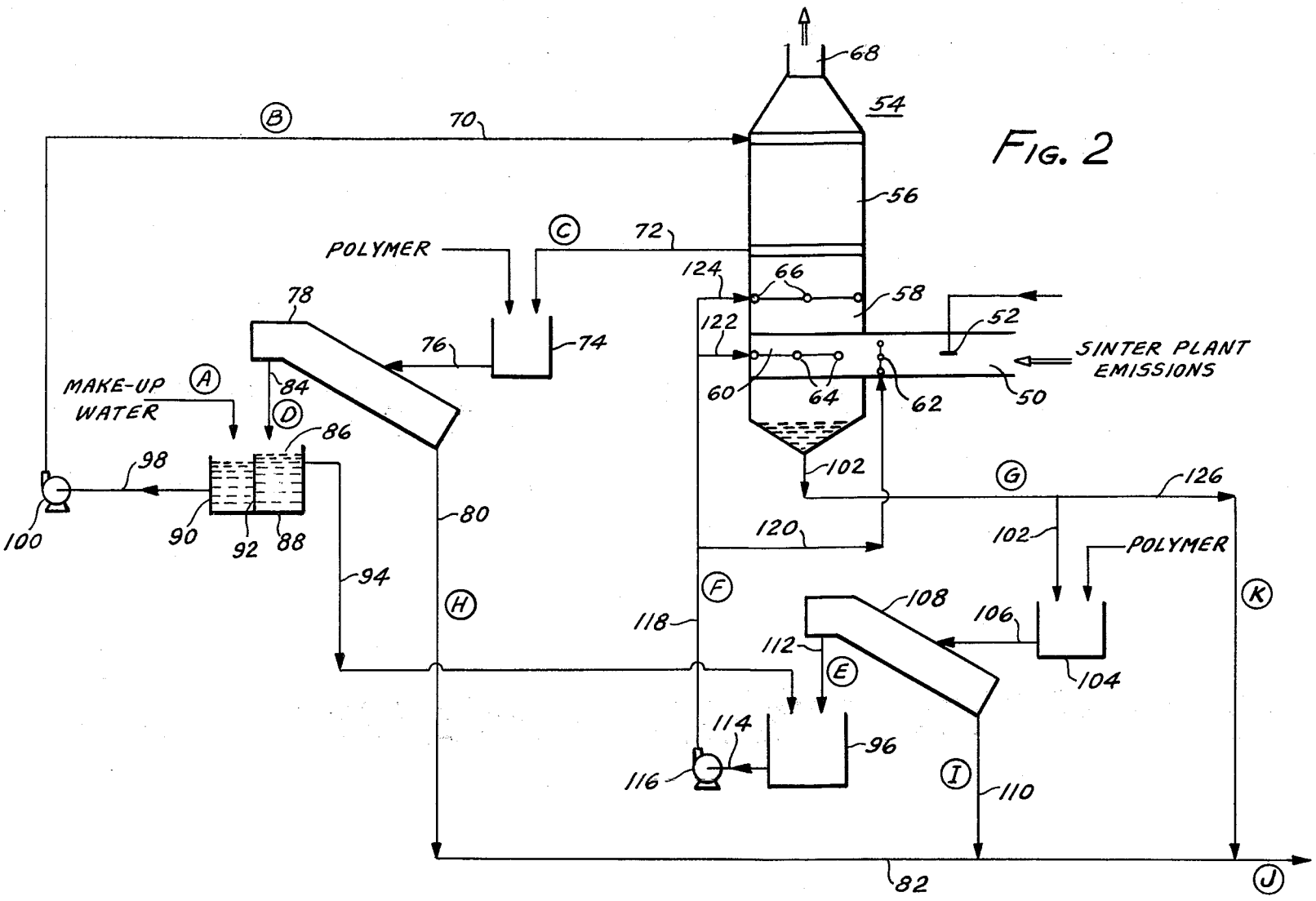
FIG. 2 is a schematic diagram of the preferred wet electrostatic precipitator system for sinter plant emissions control.
Figure 3:
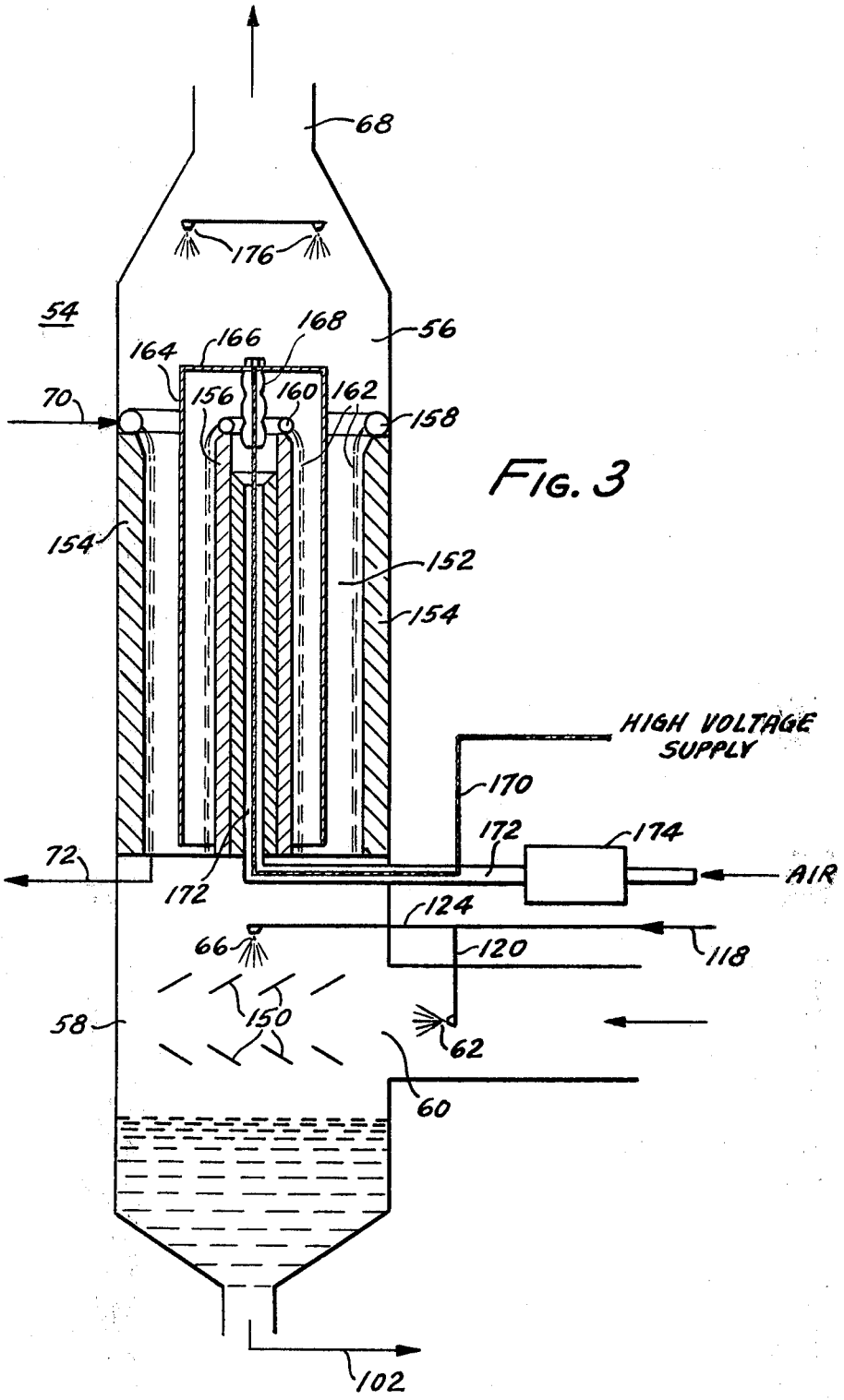
FIG. 3 is a vertical sectional view through the preferred wet electrostatic precipitator depicted in FIG. 2.

FIG. 2 is a sinter plant windbox gas-cleaning system incorporating the preferred embodiment of the invention. The system is designed to afford both an environmentally clean sinter plant exhaust gas and a minimal water discharge. The sinter plant emissions flow through conduit 50 where it is saturated with a water vapor fog introduced by air aspirated nozzles 52. The sinter plant windbox gas stream tangentially enters the prescrubber section 58 of cylindrical wet electrostatic precipitator 54 via a cyclonic-entry duct 60 having inlet duct sprays 62 discharging water with the flow of the gas stream and water jets 64 spraying at an angle to the gas flow to impart turbulence to the gas and to entrap particulates in water droplets. The gas stream is further impacted with water from sprays 66 in the pre-scrubber 58. With the particulates, soluble matter, condensed hydrocarbons and absorbable gases almost totally removed, the gas stream enters the high voltage section 56 where any remaining condensed hydrocarbon droplets, water entrapped particulates and fine particulates are charged by a discharge electrode causing their migration to the collector electrode where they are captured in the flowing film of washing water. The particulate- and condensable hydrocarbon-free sinter plant gas exhausts from the WESP 54 via outlet 68. A more detailed description of the preferred WESP for use in this sinter plant windbox gas-cleaning system is shown in FIG. 3 and will be described hereinafter.

The wash water for the collector electrodes in the high voltage section 56 is furnished by line 70 and is removed from the apparatus into mixing tank 74 by line 72. In mixing tank 74 an anionic polymer is added as a coagulant aid to facilitate clarification of the wash water which contains particulates and hydrocarbon coated particulates suspended in it. It is known in the art to use ionic polymers in clarification and thickening operations to improve the efficiency of liquid/solids separation processes by adsorption of the polymers on surfaces of dispersed solid particles. Due to its high molecular weight, particles adsorbed along the polymer chain form dense, rapid settling agglomerates. It is preferred that the anionic polymer added to mixing tank 74 be an anionic, very high molecular weight organic copolymer of acrylamide.

It is also possible to add first a strongly cationic liquid polymeric coagulant followed by the anionic polymer to accelerate clarification of the wash water. We have found, however, that adding the anionic polymer itself does an effective job. It should also be noted that having sufficiently large clarifiers and long enough settling time would obviate the need for polymer additions. The mixed slurry from tank 74 flows through line 76 into clarifier 78 which, as an example, is depicted here as an inclined plate clarifier but could be any conventional clarifier.

In clarifier 78 the precipitated fine particulates and polymer resin agglomerate to form a flock from which clear wash water containing only dissolved matter separates. The separated, semi-solid mass is withdrawn from clarifier 78 by line 80 and is passed into discharge line 82. The clarified wash water flows via line 84 into compartment 88 of tank 86 which is divided into two compartments by divider 92. A portion of the clarified wash water is bled through line 94 into tank 96 while the remaining amount overflows divider 92 into compartment 90 where makeup water is added. In this manner dissolved solids and very fine particulates and hydrocarbons that are not separable in the clarifier are continually removed from the high voltage recycle loop to prevent their excessive accumulation.

The diluted and clarified wash water in compartment 90 is fed by line 98 and pump 100 back into line 70 for servicing the collector electrode.

Wash water from sprays 62, 64 and 66 collects in the bottom of pre-scrubber section 58 as a particulate laden, aqueous solution of dissolved matter and absorbed gases after turbulent contact with the gas stream. It exits as dirty wash water slurry in line 102 which leads into mixing tank 104 where anionic polymeric resin is added to aid in its subsequent clarification as previously described. The mixture of slurry and polymeric resin is conveyed in line 106 to clarifier 108 shown here, for example, as an inclined plate clarifier. In the clarifier solids and resin flock settle out to be withdrawn via line 110 and discharge line 82. The clarified wash water from clarifier 108 is introduced into tank 96 by line 112 where it is mixed with the bleed-off portion of clarified wash water from the high voltage recycle loop entering tank 96 from line 94. The mixture of the two clarified wash waters from tank 96 enters pump 116 by line 114 from which the wash water is recirculated by line 118 and lines 120, 122 and 124 which branch off line 118 to furnish wash water to sprays 62, 64 and 66 respectively.

As previously stated, recirculating wash water contains dissolved solids and absorbed gases whose concentrations can deleteriously build up, and therefore, a measured amount is siphoned off via line 126 and discharged into line 82. When the gas-cleaning system is operating under equilibrium conditions, the total amount of discharge waste-water in line 82 from lines 80, 110 and 126 equals the amount of make up water added to the system in compartment 90 of tank 86. This is because the sinter plant gases entering the gas-cleaning apparatus are saturated with a water vapor fog by air aspirated nozzle 52 and exits the apparatus as a clean gas saturated with water vapor. Accordingly, no water is absorbed from the gas washing sprays by the saturated sinter gases and any water leaving the system must be accounted for by make up water.

It should be noted that the contents of discharge line 82 are sent to a water treatment facility for further treatment to bring the eventual discharge in line with wastewater regulations. Moreover, the slurry from lines 80 and 110 may be conducted to a thickener to recover more of the wash liquor for recycling and to afford a more easily handled sludge. It may also be preferable not to dilute the slurry from lines 80 and 110 or the sludge from a thickener with the bleed off wash water from line 126.

LIQUOR CHARACTERISTICS

| Location Reference to Schematic | Flow gpm | pH | TSS ppm | TDS ppm | CL ppm | $SO_4$ ppm | Ca ppm | K ppm | F(1) ppm | Oil(2,3) ppm |
|---|---|---|---|---|---|---|---|---|---|---|
| A | 300 | 7.0 | 5 | 200 | 10 | 90 | 45 | — | <1 | <1 |
| B | 1200 | 3.5 | 40 | 525 | 90 | 285 | 75 | — | 6 | 8 |
| C | 1200 | 2.9 | 170 | 630 | 115 | 350 | 85 | 30 | 8 | 20 |
| D | 1160 | 2.9 | 50 | 630 | 115 | 350 | 85 | 30 | 8 | 10 |
| E | 940 | 3.3 | 100 | 2,970 | 565 | 1,110 | 465 | 85 | 55 | 20 |
| F | 1200 | 3.2 | 90 | 2,465 | 470 | 945 | 385 | 75 | 45 | 20 |
| G | 1200 | 3.3 | 1,100 | 2,970 | 565 | 1,110 | 465 | 85 | 55 | 40 |
| H | 40 | 2.9 | 3,650 | 630 | 115 | 350 | 85 | 30 | 8 | 310 |
| I | 40 | 2.9 | 24,600 | 2,970 | 565 | 1,110 | 465 | 85 | 55 | 510 |
| J | 300 | 3.1 | 4,575 | 2,658 | 505 | 1,010 | 415 | 80 | 50 | 140 |
| Location | Flow gpm | pH | TSS lbs/day | TDS lbs/day | Cl lbs/day | $SO_4$ lbs/day | Ca lbs/day | K lbs/day | F lbs/day | Oil lbs/day |
| K | 220 | 3.3 | 2,905 | 7,840 | 1,490 | 2,930 | 1,230 | 225 | 145 | 105 |
| H | 40 | 2.9 | 1,750 | 300 | 55 | 170 | 40 | 15 | 5 | 150 |
| I | 40 | 2.9 | 11,810 | 1,425 | 270 | 535 | 225 | 40 | 25 | 245 |
| J | 300 | 3.1 | 16,465 | 9,565 | 1,815 | 3,635 | 1,495 | 280 | 175 | 500 |

(1)Soluble fluoride.
(2)Total, including oil measured as part of total suspended solids.
(3)Analyses varied over a wide range; Numbers shown are averages.

The above table shows the characteristics of the liquor at the various locations marked on the schematic diagram of FIG. 2. The data is that calculated for a full-scale installation based on demonstration test results in which a dry electrostatic precipitator preceded the WESP in-line. The gas streams treated in the demonstration WESP flowed at 49,600 avg. scfmd with an inlet loading of 0.397 avg. gr/scfd of particulates and condensable hydrocarbons and an outlet loading of 0.012 avg. gr/scfd total emission. The table is based on a projected total gas flow of 278,000 acfm @ 250° F. and 3.5% moisture (200,000 scfmd) from two sinter strands with inlet loadings of 0.42 gr/scfd and outlet loadings of 0.02 gr/scfd. The gases are cleaned by four WESP's with the recirculating high-voltage section water being treated by two inclined plate clarifiers and the recirculating pre-scrubber water being treated by one inclined plate clarifier.

The preferred embodiment of the sinter plant gas-cleaning system illustrated in FIG. 2 would operate effectively with any wet electrostatic precipitation system having a high voltage precipitator section following a pre-scrubber such as that disclosed in U.S. Pat. No. 3,958,961 to Bakke by way of an example. The apparatus must be constructed of corrosion-resistant and acid-resistant materials throughout. Preferably, the housing and internal surfaces of the WESP for both sections are an acid-resistant fiber reinforced plastic. The baffles in the pre-scrubber should also be fiber reinforced plastic and the piping for the recirculating of the wash liquor in both recycle loops is preferably high temperature polyvinyl chloride. The corrosion-resistant metal preferred for the discharge electrode is titanium, while the collector electrodes are fiber reinforced plastic, and most preferably, a vinyl ester plastic sold under its registered trademark Derakane D-411 by Dow Chemical Co.

The most preferred pre-scrubber and high voltage wet precipitator tandem device for utilization as the WESP 54 in FIG. 2 is sectionally shown in FIG. 3. Elements common to both FIGURES have been given the same identifying numbers. This most preferred integrated wetted-wall electrostatic precipitator that was adapted for effective operation with the novel separate recycling paths is sold under the trademark "HYDRO-PRECIPITROL" by Fluid-Ionics Systems, a Division of Dart Industries in Phoenix, Arizona. More detailed information concerning this particular apparatus than that disclosed below can be obtained from U.S. Pat. Nos. 3,238,702; 3,315,444; 3,315,445; 3,716,966 and 3,742,681 issued to A. deSeversky.

In FIG. 3 dirty sinter plant gases enter WESP 54 through cyclonic-entry duct 60 in which the gases are impacted with sprays of water from jets 62. The inrushing gas stream is turbulently deflected in the pre-scrubber 58 by baffles 150 and thoroughly wetted by sprays 66. In pre-scrubber 58 the gas stream is cooled, hydrocarbons are condensed, gases are absorbed and particulates agglomerate with the removal of large particulates.

The gas stream containing fine particulates, fine particulates entrapped in water droplets and a mist of water droplets and condensed hydrocarbons passes into the high voltage section 56 in annular space 152 formed by vertically disposed and concentrically arranged collector electrodes 154 and 156. Circular low pressure liquor distributors 158 and 160 dispense liquor via multiple holes to form a flushing film 162 that cascades down collector electrodes 154 and 156 respectively. Discharge electrode 164 is a metal cylindrical mesh cage suspended within annular space 152 by hanger arms 166 which are supported by insulator 168. Voltage from a high voltage supply is furnished to the discharge electrode 164 by power line 170 which enters conduit 172 and travels upwardly through the axis of the cylindrical housing and through insulator 168.

The fine particulates and droplets of water and condensed hydrocarbons are charged in annular passage 152 when a high voltage is supplied between the discharge electrode cage 164 and the liquid film 162 on the collector walls. These ionized particulates migrate toward collector electrodes 154 and 156 where they are flushed away. The contaminant-free gas stream is exhausted from the WESP 54 through outlet 68.

Several problems may occur with the WESP sinter plant gas-cleaning system during cold start-up. First of all, even though an air curtain is maintained surrounding the insulator 168 by forcing air through conduit 172, a conductive coating deposits on the cold insulator during start-up and leads to short circuiting. This difficulty is alleviated by heater 174 which heats the air curtain around the insulator to keep it warm and dry. Additionally, gas-cleaning performance of the high voltage system can be improved during cold start-up by preheating the raw windbox gases during this transient period.

The coarse particulates that are swept out of the gas stream in the pre-scrubber cannot migrate into the high voltage section to block the holes of the liquor distributor as occurred with the prior art systems in which pre-scrubber wash liquor was recycled to the high voltage section. The clogging of the holes caused dry sections to develop on the collector electrodes and thus a marked drop in cleaning efficiency. However, the fine particulates that are removed in the high voltage section are suspended in the wash liquor that is recycled in this section. The continual recirculating of the wash liquor containing the suspended fine particulates gradually may cause a build-up of mud deposits in the holes of the liquid distributors. As the hole openings decrease in size, the liquor can squirt out of the hole as a stream rather than merely flow down the collector electrode. The stream can contact the discharge electrode and short circuit the system. By connecting the liquid distributors to a compressed air line, not shown in FIG. 3, the holes can be blown open and maintained totally operational by periodic air blasts.

Furthermore, it is believed that when cleaning a very dirty gas stream with this WESP system, depositions on the dry surface of the liquor distributors and hanger arms can occur over an extended period of operation. Washdown sprays 176 can be activated intermittently to clean off this accumulation.

In the practice of this invention it is preferable to pretreat the gas stream in a cyclone or other mechanical cleaning device prior to its entry into the WESP although this is not necessary. In this manner the size of such a WESP gas-cleaning system and the cost of installing and operating it can be minimized. Many sinter plants already have dry electrostatic precipitators cleaning the gases from the windbox. In these situations it may be economically favorable to leave them in line and add the WESP system downstream.

We claim:

1. A method for removing particulates and condensable hydrocarbons from sinter plant emission gas streams that also contain acidic gases and soluble solids in which the sinter plant emission gas streams are passed through a wet electrostatic precipitator constructed of acid and corrosion resistant materials and having a pre-scrubber section with liquor spraying means for spraying aqueous liquor preceding a high voltage precipitator section that has a discharge electrode and a collector electrode which is washed with an aqueous liquor from a liquor dispensing means comprising:

(a) operating the wet electrostatic precipitator in an acidic mode with a pH range from about 2 to about 6.5 in both the pre-scrubber and high voltage sections, (b) collecting the pre-scrubber aqueous liquor, maintaining it within a pH range of about 2 to about 6.5 and recirculating it to the spraying means in a liquor recycle loop in the pre-scrubber section, and (c) collecting the aqueous liquor draining from the collector electrode, maintaining it within a pH range of about 2 to about 6.5 and recirculating the aqueous liquor to the dispensing means for washing the collector electrode in a recycle loop in the high voltage section.

2. A method according to claim 1 wherein a portion of the recirculating liquor of step (b) is discharged.

3. A method according to claim 2 wherein a portion of the recirculating liquor of step (c) is conducted into the pre-scrubber liquor recycle loop.

4. A method according to claim 3 wherein a clarifier is disposed in the high voltage section recycle loop from which a slurry is removed for discharge and clarified liquor is recirculated to the high voltage recycle loop.

5. A method according to claim 2 wherein a clarifier is disposed in the pre-scrubber recycle loop from which a slurry is removed for discharge and clarified liquor is recirculated to the pre-scrubber recycle loop.

6. A method according to claim 1 wherein a portion of the recirculating liquor of step (c) is discharged.

7. A method according to claim 1 wherein a clarifier is disposed in the pre-scrubber recycle loop from which a slurry is removed for discharge and clarified liquor is recirculated to the pre-scrubber recycle loop.

8. A method according to claim 1 wherein a clarifier is disposed in the high voltage section recycle loop from which a slurry is removed for discharge and clarified liquor is recirculated to the high voltage recycle loop.

9. A method according to claim 1 wherein the acidic mode is a pH range from about 2.5 to about 5.

10. A method according to claim 9 wherein the acidic mode is a pH range from about 3 to about 4.

* * * * *